United States Patent [19]

del Ser Gonzalez

[11] Patent Number: 4,488,394

[45] Date of Patent: Dec. 18, 1984

[54] BOTTLE-SEALING MACHINE

[76] Inventor: Clemente del Ser Gonzalez, Paseo Talleres, No. 36, Madrid, Spain

[21] Appl. No.: 254,769

[22] Filed: Apr. 16, 1981

[30] Foreign Application Priority Data

Apr. 19, 1980 [ES] Spain ..... 490.733

[51] Int. Cl.[3] ..... B65B 11/00

[52] U.S. Cl. ..... 53/585; 53/291

[58] Field of Search ..... 53/291, 585, 295–298, 53/557, 567

[56] References Cited

U.S. PATENT DOCUMENTS 3,738,210 6/1973 Fujio ..... 53/291 X
3,858,365 1/1975 Fernandez ..... 53/567 X
4,016,704 4/1977 Fujio ..... 53/585
4,208,857 6/1980 Fujio ..... 53/585

FOREIGN PATENT DOCUMENTS 1004644 1/1977 Canada ..... 53/291

*Primary Examiner*—A. J. Heinz
*Attorney, Agent, or Firm*—Toren, McGeady and Stanger

[57] ABSTRACT

A bottle-sealing machine for placing capsules of thermoshrinkable plastic material on the necks of bottles. The capsules are automatically cut from a continuous coil of a plastic tube, the capsules are placed over the necks of the bottles and the capsules are subsequently subjected to a heat treatment which causes the plastic material to adapt to the irregularities of the necks of the bottles.

13 Claims, 8 Drawing Figures

BOTTLE-SEALING MACHINE

SUMMARY OF THE INVENTION

The present invention relates to a bottle-sealing machine, specifically of the type which uses as a seal a capsule of thermo-shrinkable plastic material, in such a way that when the machine has deposited the plastic cylindrical capsule over the neck of the bottle, the capsule is subjected to heat treatment which causes it to contract with perfect adaptation to the irregularities of the neck of the bottle, which is perfectly sealed.

The present sealing machine uses a continuous coil of plastic tube on which it makes the appropriate cuts to obtain the capsules, in such a way that the machine entrains the continuous plastic tube of suitable size completely automatically, cuts it to obtain the capsule, deposits it over the neck of the bottle, and levels it perfectly in height with respect to the mouth of the bottle.

For this purpose the machine is provided with an introducer device constituted by a vertical cylinder housed in the interior of the plastic tube which forms the capsules and which is supplied by suitable means of transmission from a coil installed in the machine. Collaborating with this introducer device are two gripper elements each operated by pneumatic cylinders in such a way that through adequate synchronism between the movements of opening and closing of these two gripper elements, and the telescopic nature of the introducer device against the tension of a spring, intermittent downward displacement of the plastic tube is achieved, a cutting operation taking place in parallel with each intermittence of this movement to obtain the corresponding capsule.

This intermittence in the downward displacement of the plastic tube is effected in perfect correspondence with the intermittent movement beneath the head of the machine of the bottles that are to be sealed. The bottles are supplied by an endless belt and they reach the vertical corresponding to the sealing head with the collaboration of pairs of star-shaped discs which, acting on the neck and the body of the bottle, determine the stopping of the bottle in perfect vertical alignment with the introducer element at the exact moment when the capsule has to be deposited or introduced.

Of the two pneumatic gripper elements the upper one is fixed with respect to the machine head, while the lower one is mobile, for the purpose of performing the appropriate displacements for entraining the plastic tube. This second gripper is associated with a plate which slides vertically due to the effect of the eccentric coupling of the gripper to a rotary disc driven by the corresponding electric motor. The lower gripper is accompanied in its vertical displacements by the cutting device.

Since the length of the capsule varies in relation to the dimensions of the different bottles to be sealed, it is provided that the degree of eccentricity with which the sliding plate is connected to the disc driven by the motor can be regulated at will, so that the amplitude of the vertical displacement of the lower gripper and, consequently, the length of the capsule to be supplied are varied. But, in addition, the opening and closing of both grippers are governed by a photoelectric cell installed between them and associated with the plate which slides vertically; the photoelectric cell also being assembled with the nature of sliding, so that its relative position with respect to the grippers can be varied at will within determined limits, which represents a second possibility of variation of the length of the capsules.

Logically, all the devices of the machine must be duly synchronized, this synchronism being effected with the aid of the movement of the electric motor thereby that, on the shaft of the disc with which the sliding plate is eccentrically associated, a pinion is installed which, with the collaboration of a suitable driving chain, transmits the movement to a second shaft constituting a camshaft which, acting on appropriate microswitches, governs the electro-valves of the machine which control the different mobile devices of the machine.

The fact should also be pointed out that the headpiece is mounted on two vertical guides which permit the headpiece to adopt any stable position along the length of the guides, these guides being hollow, and related with their interior are respective spindles on one of which, superiorly and integrally an operating handwheel is placed on it and a pinion is incorporated for the transmission by chain of the movement towards the second spindle also provided with a superior pinion, so that the operation in either direction of the above-mentioned handwheel causes the ascending or descending displacement of the headpiece.

In regard to the cutting device, which, as has been said, accompanies the lower gripper element in its vertical displacements, it is constituted by a ring which encircles the cylinder corresponding to the introducer device, upon which ring there are assembled blades which swing due to a rocker element, with the collaboration of a blade-carrier crown related with the ring by means of bearings. The blade-carrier crown receives a continuous or intermittent rotary movement from a pneumatic motor duly connected to it. As has been said previously, the blades are mounted on the crown in such a way that they can swivel, each of them determining a rocker element articulated at its mid zone, which incorporates the blade on one of its ends, while on the other it has a guide element with respect to which the conical face of a cam can act, causing the swinging of the blades against the tension of a spring which connects its blade-carrier ends.

This conical cam is governed by a pneumatic cylinder whose action is duly synchronized with the other devices of the machine.

Parallel with the capsule introducer device provision has been made for an elastic rammer, provided with vertical movements, because it is installed on the same mobile plate or shoe of the headpeice, in such a way that simultaneously with the deposit of a capsule on a bottle, the rammer acts on the previously encapsuled bottle, acting on the projecting edge of the corresponding capsule and determining its perfect positioning.

From all the foregoing it is deduced that the machine described establishes a work cycle which repeats itself continuously and indefinitely, provision having been made on the bottle feeder element for a detector which may be constituted by a microswitch, a photoelectric cell, or any other similar element, in such a way that in the case of the possible absence of a bottle the detector acts on the machine's programming system, putting the devices for entraining the plastic tube or continuous capsule out of service, in order to avoid waste of material.

To complement the description which will be given hereinafter and for the purpose of aiding a better understanding of the characteristics of the invention, this specification has attached to it as an integral part hereof, a set of drawings in which the following has been represented in an illustrative but not a limitative manner:

DETAILED DESCRIPTION OF THE INVENTION

Figure 1A:
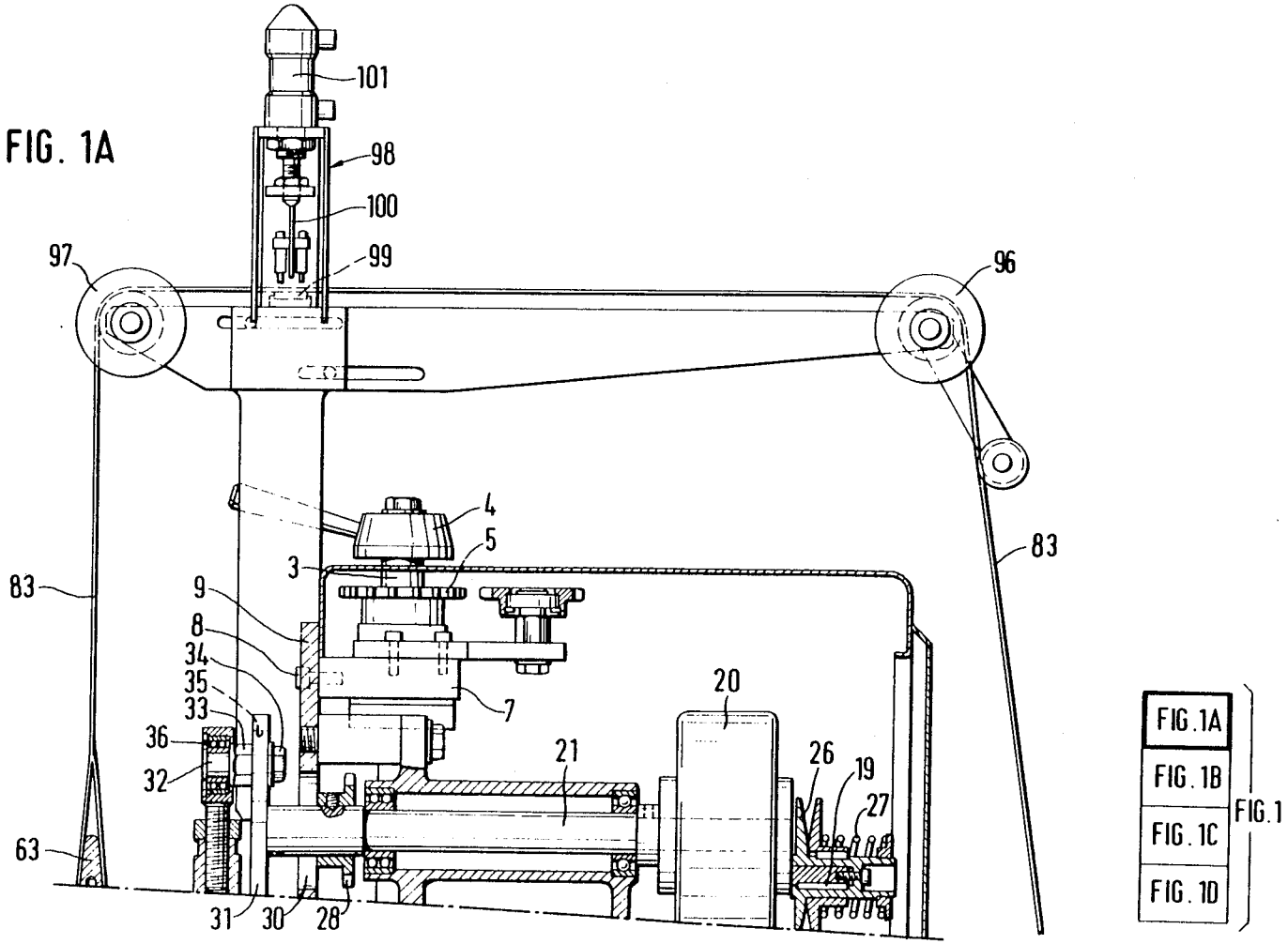
FIGS. 1A, 1B, 1C and 1D show a lateral elevation of the bottle-sealing machine which constitutes the object of this invention, which is shown without its protective casing and sectioned antero-posteriorly at the level of the introducer device, to allow the different elements that constitute it to be seen more clearly.

In view of these figures it is possible to see how the machine is constituted on the basis of a support bedframe 1, on which two strong vertical columns 2, are assembled, which support the assembly which constitutes the headpiece of the machine, which, as has been said previously, is vertically displaceable with respect to the bedframe 1, due to the existence of spindles 3, which thread in the hollow interior of the columns 2 and of which one incorporates an operating handwheel 4, as well as a pinion 5, proximate to the handwheel which, with a suitable driving chain, supplies movement to the pinion 6 installed on the other spindle 3, in order to obtain a perfectly synchronized movement of the two spindles in their displacement with respect to the columns 2.

Evidently, to obtain this effect the headpiece must be fixed rigidly with respect to the spindles 3, which is effected close to the superior end of the elements by a bridge 7 to which at 8 a plate 9 is screwed, which plate supports the different devices of the headpiece and to which, in turn, the bushings 10 which slide on the above-mentioned guides 2, are fastened.

The plate 9 has fastened to it frontally in the first place the fixed gripper 11, constituted by a rectangular frame which is fastened at 12 to the plate 9, while frontally it receives the pneumatic cylinder 13, which effects the appropriate movements with respect to the mobile mouth 14 of said gripper. Between the mobile mouth 14 referred to and the fixed mouth 11 there is a cylindrical clamp capable of fixing to the introducer device 15.

The plate 9 has fastened to it frontally, in addition to the fixed gripper 11, a pair of vertical guides 16, conveniently distanced from it by means of support elements 16, in such a way that this pair of vertical guides 16, constituted respectively by vertical cylindrical rods, permits a perfect vertical displacement of the sliding plate or shoe 17, the structure of which will be described later.

The plate 9 has fastened to its posterior face the electric motor 18, which operates the shoe, the clutch assembly 19, the reducer 20, the transmission shaft 21, the camshaft 22, the microswitch set 23, and other accessories of the machine, and also the casing 24, which envelopes all these mechanisms.

The electric motor 18, by means of a trapezoidal belt which has not been represented in the figures, and with the collaboration of the pulleys 25 and 26, transmits the movement to the clutch 19 which acts at the same time as a tensor for the belt, due to the existence of the spring 27, which tends to push together the two halves of the body of the pulley. The movement transmitted to the shaft 21 through the pinion 28 and the other 29, existing on the camshaft 22, is transmitted in turn with perfect synchronism to the latter. The shaft 21 traverses the plate 9 through a window 30 operatively formed in the plate and is made fast at its free frontal end to a revolving plate 31 on which there is eccentrically assembled a short pivot 32 fastened to the disc or plate 31 by means of a double nut 33, 34, so that the pivot 32, by means of previously loosening the nut 34, can move within the orifice 35 to displace radially with respect to the center of the plate 31, thus varying the eccentricity of the plate.

On the free frontal end of the pivot or rod 32, by means of the bearings 36, a connecting rod 37 is assembled which, at its lower end and by means of the swivelling shaft 38, is the element which transmits movement to the above-mentioned sliding plate or shoe 17.

Fastened to this shoe 17, specifically at the point referenced 39 is the lower or mobile gripper 40, similar in structure to the upper gripper 11, and also provided with a pneumatic driving cylinder 41, in such a way that this lower gripper 40, in addition to the movements of opening and closing supplied by the cylinder 41, is subjected to a constant alternative vertical movement caused by the continuous rotation of the electric motor 18.

Also on this plate or shoe 17, accompanying it in its movements, and more specifically on the frame of the lower gripper 40, a photoelectric cell 42 is installed which governs the opening and closing of the lower gripper 40.

Figure 1B:
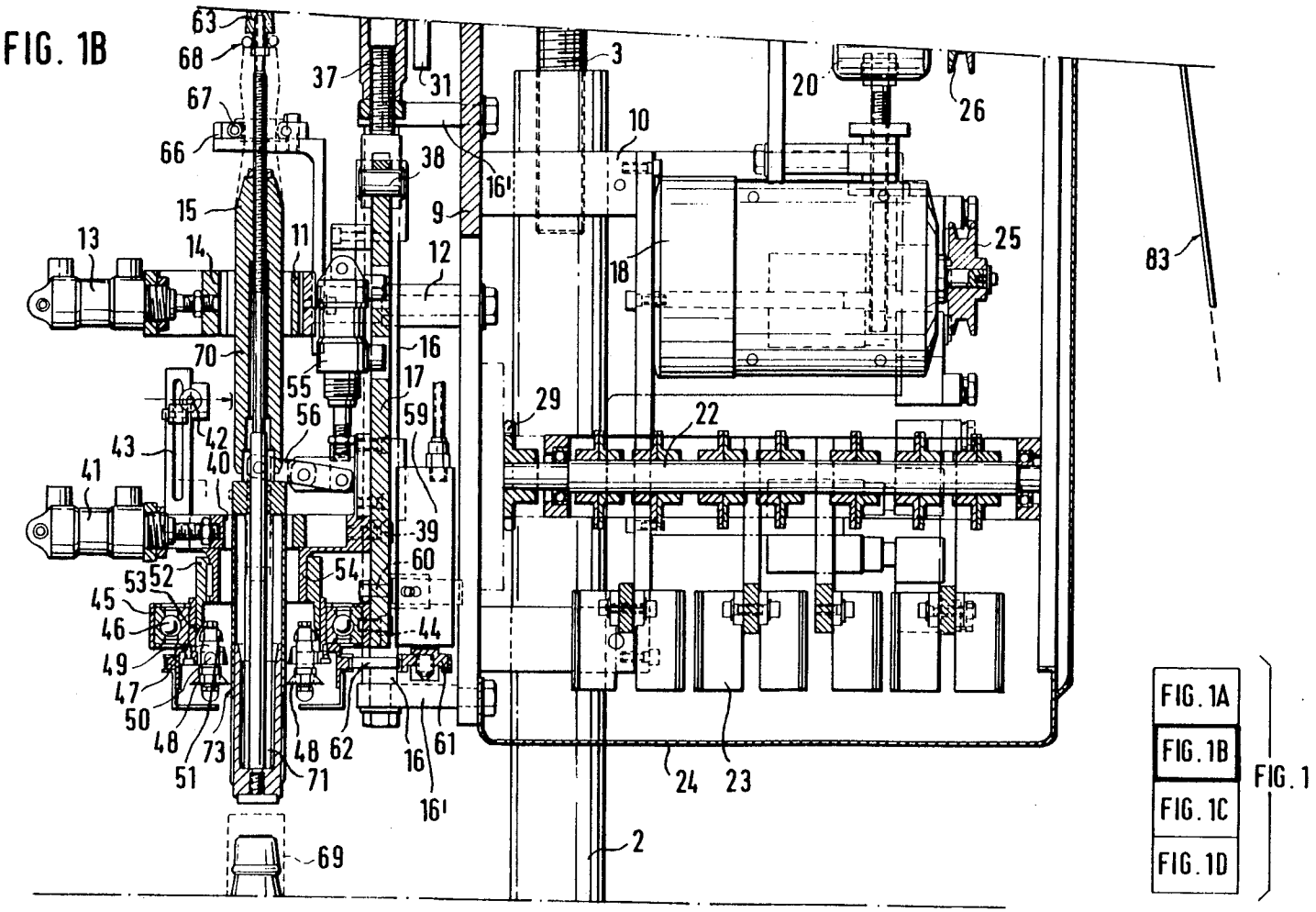
Figure 1C:
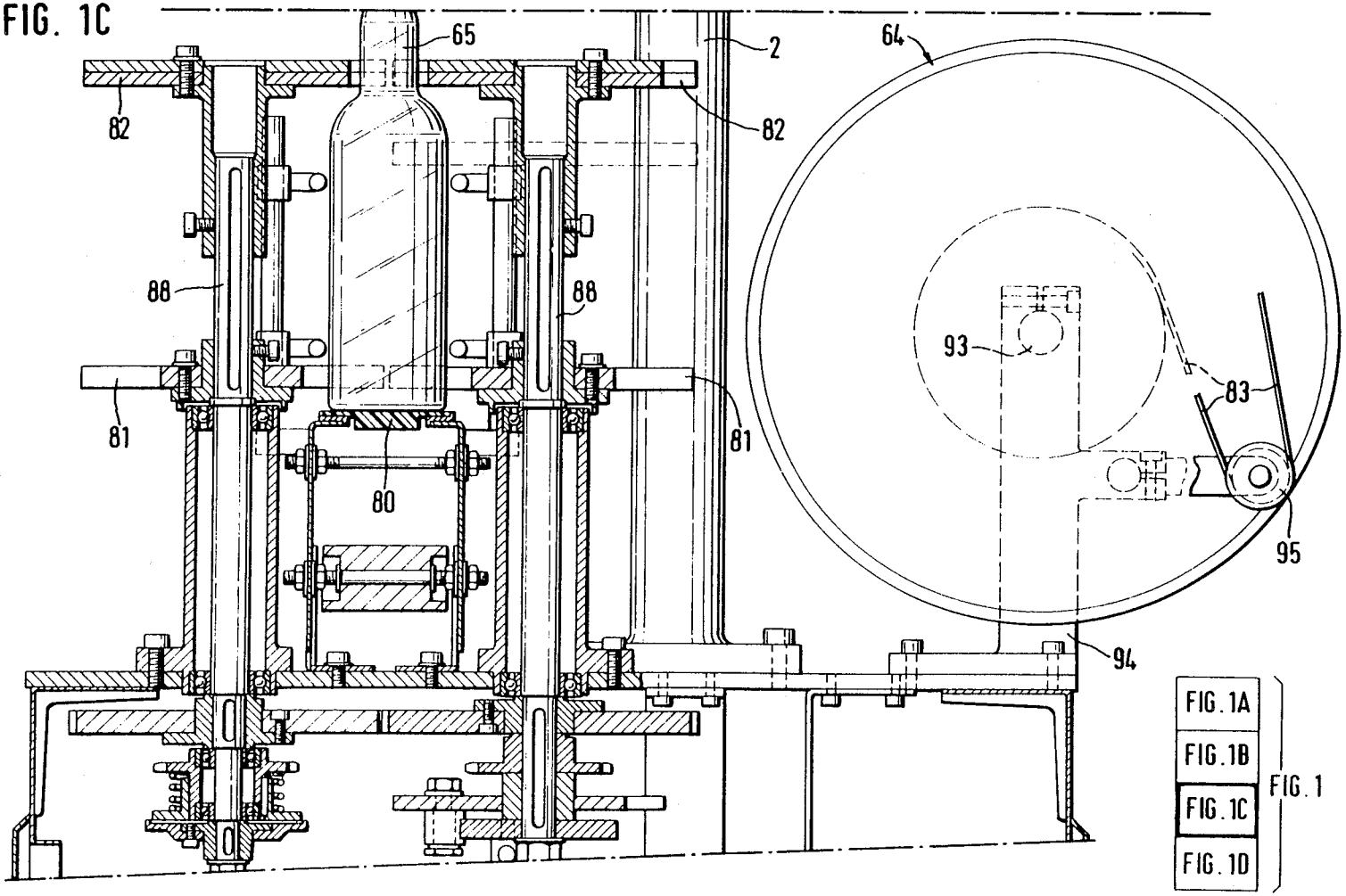
Figure 1D:
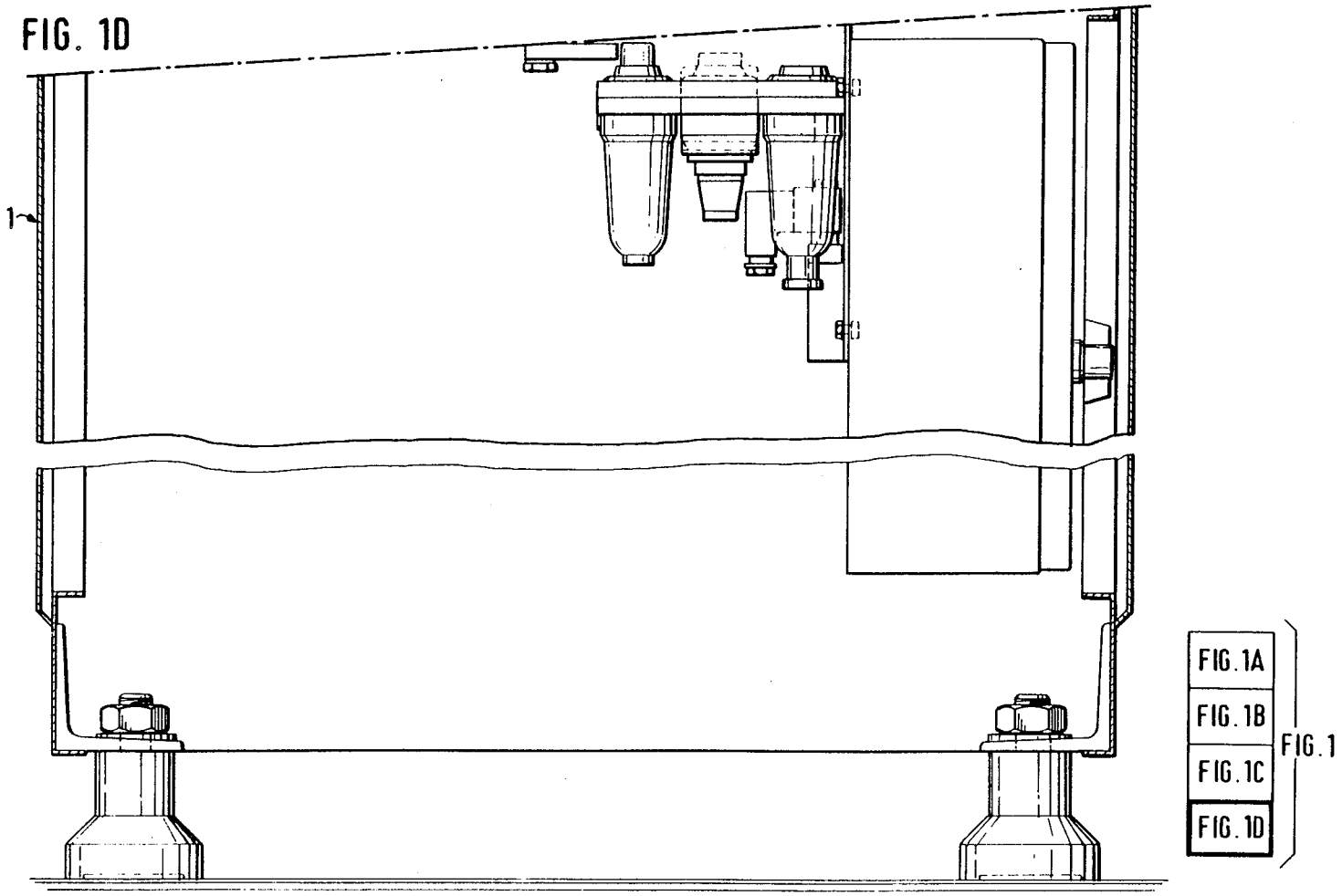
Figure 2A:
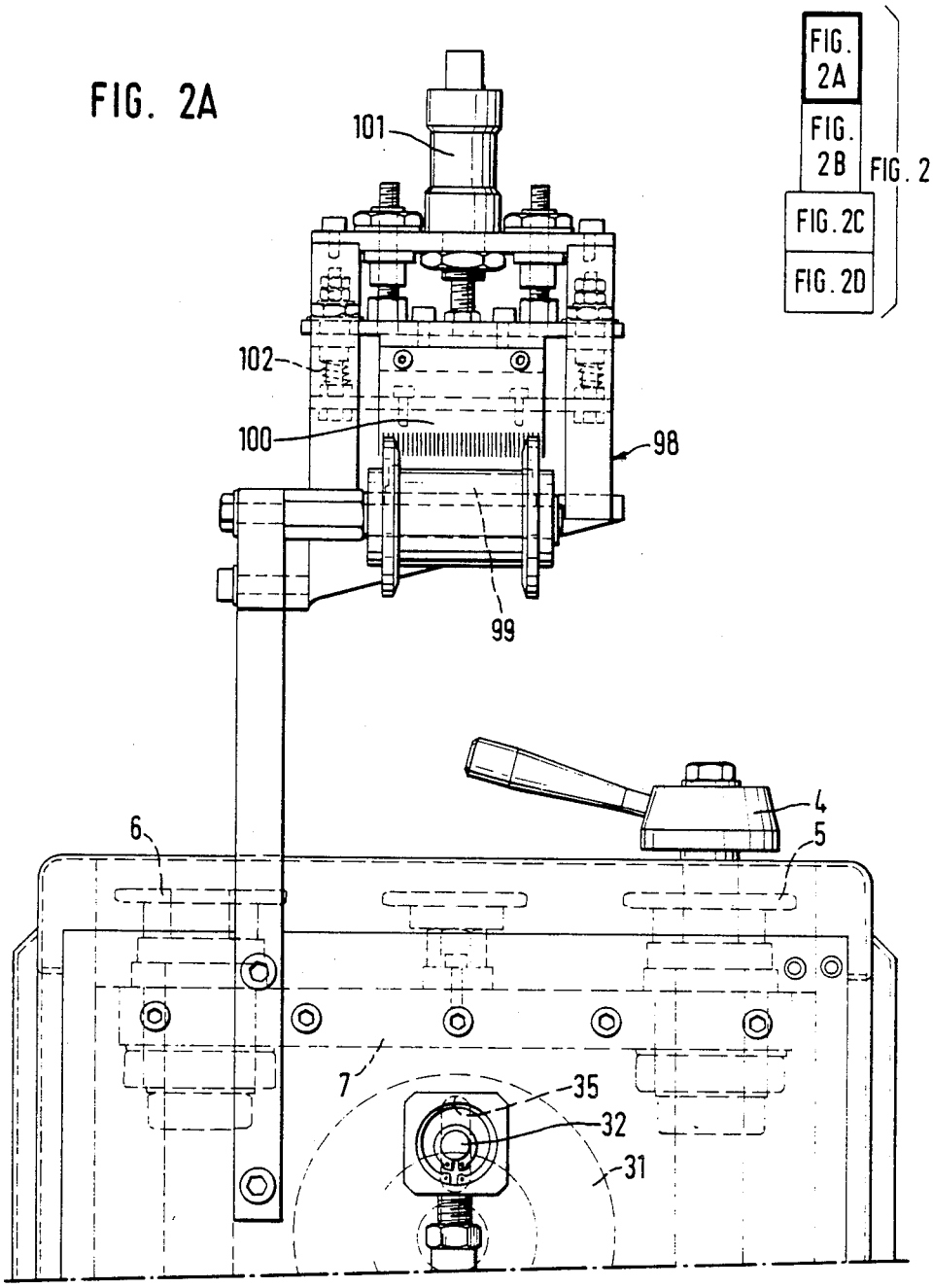
FIGS. 2A, 2B, 2C and 2D show a frontal elevation of the same machine which is also sectioned at the level of the same device.
Figure 2B:
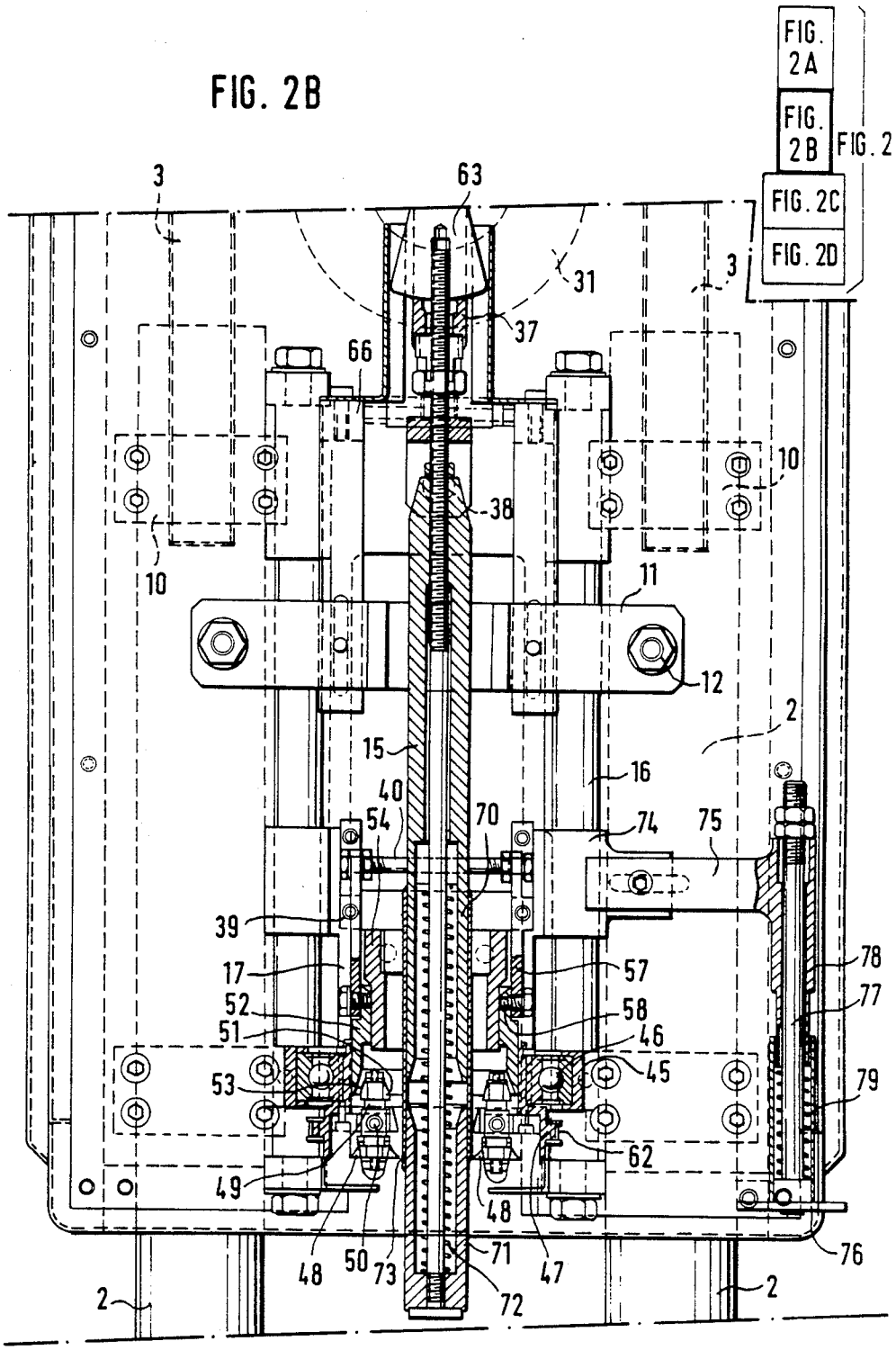
Figure 2C:
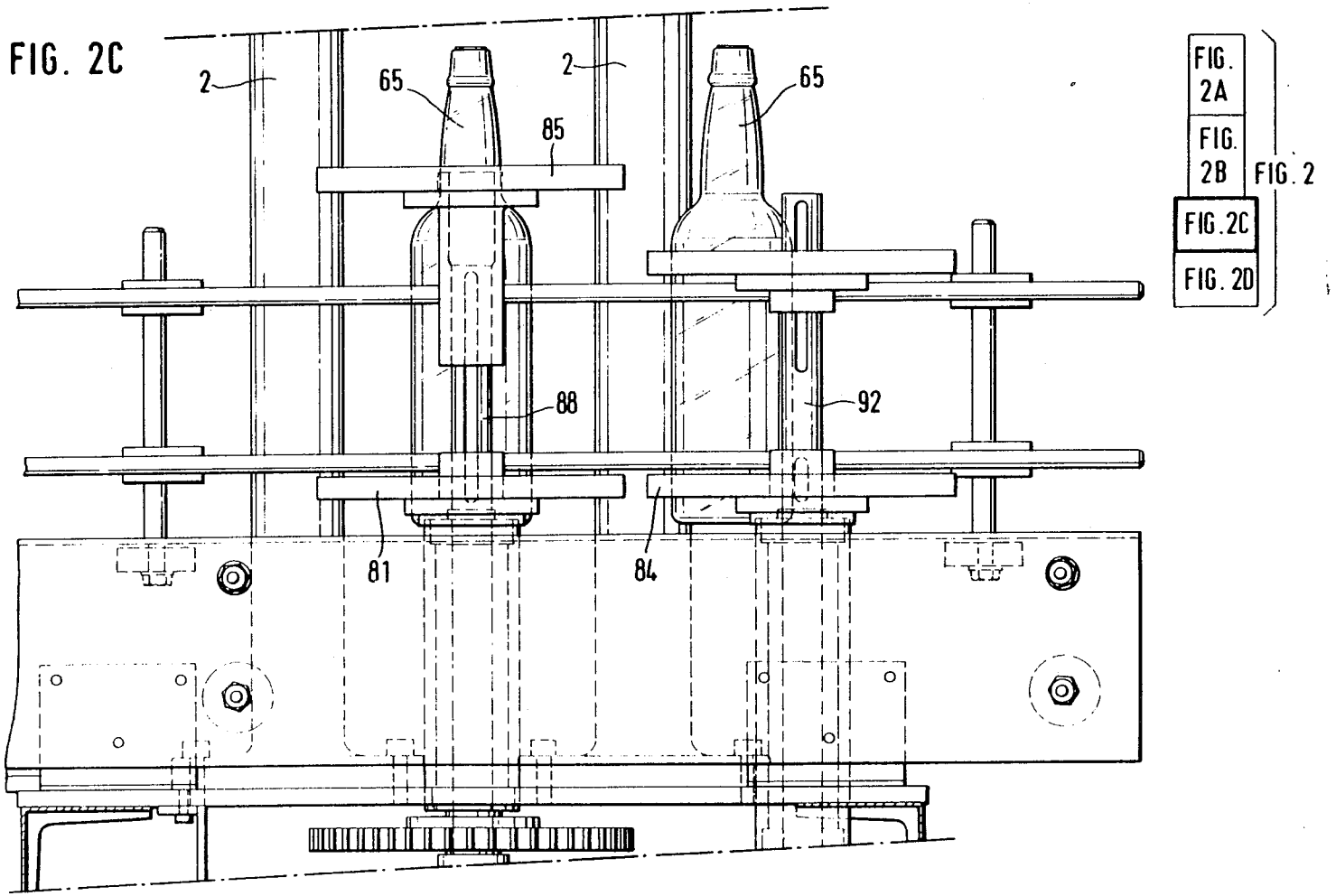
Figure 2D:
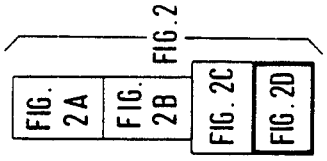
Figure 2D:
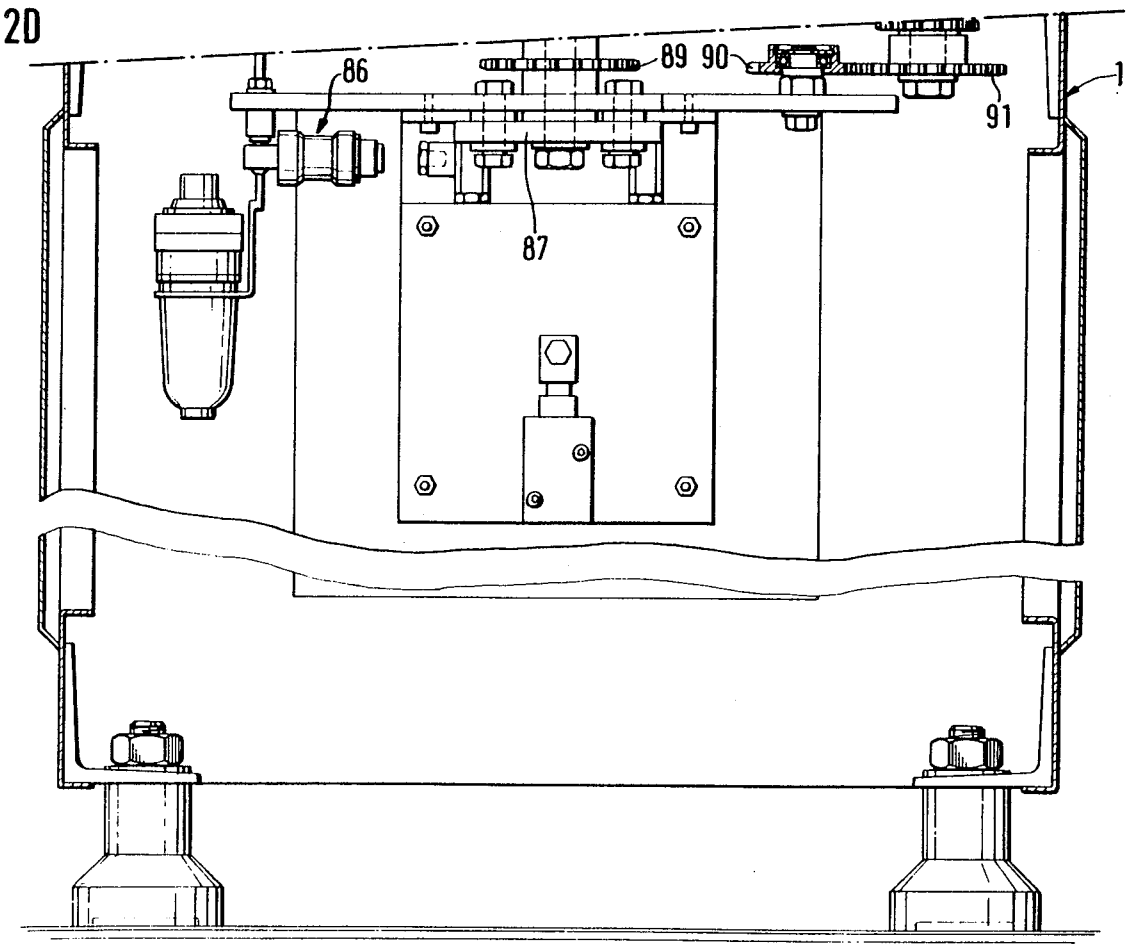

This electrovalve 42, as can be seen in FIG. 1, is mounted with the character of vertical sliding on a support 43 in order to effect a perfect regulation in height of the valve so that the closing of the lower gripper 40 is effected at a suitable moment determined by a plurality of signals existing in the continuous capsule which activates the cell.

In the lower extreme zone of the shoe 17, specifically at 44, an annular blade-carrier body 45 is assembled, which, by means of a bearing 46, encircles a crown 47 on which the blades 48 are installed. These blades 48 swivel by means of a rocker element as has been said, and they are installed on the lower end of an arm 49 which is articulated at its mid zone 50 to the blade-carrier crown 47, while each of the rocker elements has a guide 51 on its upper end.

The blades proper 48, are permanently directed towards the cutting position by springs which connect the extremities of the arms 49 corresponding to the placement of the blades, which have not been represented in the figures, while there is a cam 52 with a conical face 53 which, acting on the above-mentioned guides 51, tends to keep the blades 48 in a non-operational position.

The cam 52 is cylindrical in shape and is mounted with the nature of being displaceable on a bushing 54, which is an axial inferior extension of the support frame of the lower gripper 40, the cam being driven by a pneumatic cylinder 55, installed on the shoe 17 which, by means of a connecting rod 56 acts on a forked element 57 which upwardly displaces the cam 52 by means of the articulated joint 58.

The blade-carrier crown 47 rotates constantly or intermittently on the body 45 and by means of the bearing 46, due to the effect of a pneumatic motor 59 secured at 60 to the posterior face of the shoe 17, whose pulley 61 is connected by the belt 62 to a perimetrical channel that exists on the crown 47.

Thus, both the upper gripper 11 and the lower gripper 40 and also the cutting device synthesized in the blades 48, properly speaking, encircle the introducer device 15 which in the working position of the machine, is always held fast either by the upper gripper 11 or by the lower gripper 40, since the opening of either of them is effected simultaneously with the closing of the other.

The introducer device 15 has a generally cylindrical shape and it has a superior head 63 which has a special shape as can be seen in the figures, and whose purpose is to initiate the deformation of the continuous capsule or plastic tube, since the latter emerges from the coil completely flattened, and has to adopt the suitable cylindrical shape for its attachment to the neck of the bottle 65. Immediately under the headpiece 63 a support ring 66 has been provided, which is provided with guides 67, the same as the headpiece 63, which also has inferior guides 68, the ring 66 having the purpose of preventing the introducer device 15 from falling into a possible position of stoppage of the machine in which both grippers 11 and 40 can be open.

Behind the headpiece 63, which has the configuration mentioned, the body of the introducer device 15 adopts the cylindrical configuration corresponding to the configuration intended for the capsule 69.

Two halves, 70 and 71 are established on the body of the introducer device 15, which are independent with respect to each other and which are connected by means of a spring 72 which permits, against its tension, the ascending displacement of the inferior sector 71 in the direction of approximation to the superior sector 70, the inferior mobile sector being guided by a cylindrical bushing 73 fastened to the superior sector.

Also on the shoe 17 itself, specifically on one of the bushings 74, by means of which the shoe slides on the vertical guides 16, a lateral arm 75, is installed, which constitutes the support element of a rammer 76, which is rigidly fastened to a rod 77 mounted telescopically in the interior of a vertical cylindrical bushing 78, in such a way that the rammer 76 is retractable against the tension of a spring 79. The rammer 76 which is advanced with respect to the introducer device 15, has the purpose of definitively positioning the capsule over the neck of the bottle 65, after the capsule has been positioned over the bottleneck in a previous work cycle. Thus, simultaneously with the introduction of a capsule 69 on the bottle 65, the rammer 76 definitively positions the capsule on the bottle encapsuled in the preceding work cycle of the machine.

The bottles 65, as has been said, are supplied to the machine by a conveyer belt 80 and are perfectly positioned by means of two pairs of star-shaped discs 81 and 82, of which the lower pair 81 acts on the body of the bottle 65 while the upper pair acts on the neck of the bottle. The operation of these star-shaped discs 81 and 82 is duly controlled by the camshaft 23, so that the positioning of the bottle 65 on the vertical shaft corresponding to the introducer device is done at the moment prior to the capsule 69 being deposited, the bottle being entrained towards the following step during the rest of the cycle in which the headpiece, by means of the combined action of the grippers 11 and 40, entrains the continuous capsule 83 in a suitable pre-established magnitude due to the location of the photoelectric cell 42.

Two further pairs of star-shaped discs 84 and 85 determine the perfect positioning of the bottle with respect to the rammer 76 which, as has been said, determines the definitive positioning of the capsule 69.

Each bottle 65, when it reaches the pairs of star-shaped discs 81 and 82, must act on a microswitch or a photoelectric cell which detects its presence and, in its absence, cancels the devices provided in the machine for entraining the continuous capsule 83.

Evidently the amplitude of the partial rotation effected by the two pairs of star-shaped discs, 81, 82, 84 and 85, is a function of the number of arms they have, the partial rotations being effected with the aid of a pneumatic or hydraulic cylinder 86, housed in the interior of the bedframe 1, which acts on ratchets 87 installed on the inferior extremity of the shaft 88 corresponding to the two pairs of star-shaped discs facing the introducer mechanism 15, the shaft also having a toothed wheel 89 which meshes with another toothed wheel, not shown, for the transmission of movement to the pinion 90 and from the pinion 90 to another toothed wheel 91, made fast to the shaft 92, corresponding to the two pairs of star-shaped discs situated facing the rammer 76, in such a way that the movement of the two shafts 88 and 92 is perfectly synchronized and consequently also the rotation of the star-shaped discs 81 and 82 with the star-shaped discs 84 and 85.

In accordance with the structure described, the machine functions as follows:

When the headpiece has been suitable positioned with respect to the bedframe 1 by means of action on the handwheel 4, and the displacement of the headpiece with respect to the vertical columns 2, and when the photoelectric cell 42 has been duly positioned with respect to the fixed gripper 11 and the mobile gripper 40, the continuous capsule or plastic tube 83 forming the coil 64, is installed freely rotating by means of its shaft 93 on a support 94 placed on the bedframe 1 immediately behind the bottle 65 feed line. From the coil 64 the continuous capsule is caused to pass through a tensor roller 95 from which it ascends towards another tensor roller 96 situated in the postero-superior zone of the machine, and from the latter to another guide roller 97 situated in the antero-superior zone of the machine and arranged in the vertical corresponding to the introducer device 15 pursuant to the passage of the continuous capsule 83 through a stamping head 98 in which there is an elastic seat 99 and a knife in the form of a comb 100, which is operated by a pneumatic cylinder 101 against the tension of springs 102, provided to effect the perforation of each capsule 69 along the cutting line intended to subsequently facilitate the rupture of the seal at the time of consumption.

The continuous capsule 83 reaches the head 63 of the introducer device 15 and slides over the whole of its cylindrical body, being interposed between the latter and the assembly constituted by the two gripper elements and the cutting device.

In a parallel manner the bottles 65 supplied by the transporter belt 80 have reached the perpendicular corresponding to the introducer element 15, perfectly governed by the star-shaped discs 81 and 82.

Following this situation the work cycle is the following: with the upper gripper 11 in the closed position, the continuous capsule 83 is in an immobile position, while the lower gripper 40 is open and is being displaced upwards together with all the mechanisms associated with the shoe 17 through the effect of rotation caused by the electric motor 18 and supplied continuously to the shoe through the connecting rods 37. At a determined moment of the ascent of the lower gripper 40, the photoelectric cell 42 intercepts in its path the signal existing in the continuous capsule 83, it is activated, and causes the operation of the pneumatic cylinder 41 with the corresponding closure of the lower gripper 40. Simultaneously the operation of the upper pneumatic cylinder 13 in the opposite direction is caused, with which the upper gripper 11 opens, the lower gripper entraining the continuous capsule 83 upwards until the shoe 17 reaches its extreme superior position, at which moment its movement becomes a descending movement. Since the lower gripper 40 is closed and the upper gripper 11 is open, the first in its downward displacement entrains the continuous capsule 83 in a magnitude determined by the eccentricity that exists in the pivot 32 with respect to the plate 31, and due to the correction determined by the location of the photoelectric cell 42. In a parallel manner the pneumatic cylinder 55 retracts the cam 52 with which the blades 48 are transferred to the operational position, effecting the cutting, at the same time that the pneumatic motor comes into operation, if an intermittent system has been established for it.

In this downward displacement of the lower gripper, the lower body 71 of the introducer device 15 comes to a stop frontally on the mouth of the bottle 65, so that while the upper body 70 and the bushing 73 are displaced, the lower body 71 retracts against the pressure of the spring 72.

At the same moment that the lower gripper 40 opens, the tension stored in the spring 72 makes the superior body 70 displace upwards, recovering its original position, and being immediately gripped by the upper gripper 11 which passes to a closed position prior to which the deactivation of the pneumatic cylinder 55 is effected, with the passing of the blades 48 to the rest position; the assembly of mechanisms remaining in the same position as when the cycle began, perfectly situated for continuous repetition of the cycle.

In accordance with the description given up to now, on the shoe of the machine an introducer device is installed, assisted by a pair of grippers and a cutting device, but evidently on the shoe the switch with its accessory devices can be duplicated or quadruplicated with respect to the shoe, by only providing the shoe with a suitable width in each case to avail of the necessary coils 64 which supply the continuous capsule, and the corresponding bottle 65 feed lines.

The only important difference is that compared with the lateral feed that has been represented in the figures in the case of the single introducer device described, in the case of multiple introducer devices, the feed should be frontal.

In the multiple case, except for imperative differences of size in the bedframe and other accessories of the machine, the machine will also incorporate two single columns for supporting the whole headpiece, a single motor group with a single transmission towards a single shoe and towards a single camshaft, with the exception that in the shoe and only in it, the mechanisms will be multiplied in accordance with the number of feed lines established, the devices corresponding to each of these lines functioning in perfect synchronism with those of the other lines.

The materials, form, size, and arrangement of the elements may be varied, provided that the spirit of the invention is not altered.

The terms in which this specification is worded should be taken in a wide and not a limitative sense.

I claim:

1. A bottle-sealing machine for placing capsules of thermoshrinkable plastic tubular material obtained from a continuous coil on the necks of bottles, comprising a bed frame, a linear transporter belt established on said bed frame for entraining the bottles, retention mechanisms for stopping each bottle in the region where the bottle is to receive a capsule for the time necessary for placing the capsule on the neck of the bottle, two vertical cylindrical guides situated on said bed frame, a headpiece mounted on said guides in a manner such that said headpiece can adopt any stable position along the length of said guides, said headpiece including a vertical plate, a first gripper fixed to a front of said plate, and a motor situated on a back face of said plate, the shaft of said motor extending through said plate and incorporating an eccentric which, through a connecting rod, supplies a reciprocal vertical movement to a second gripper aligned with said first gripper and situated below it, each of said grippers including two semicylindrical arches forming generally circular apertures for receiving the tubular material, wherein the imaginary axes of said arches are vertically aligned; an elongated introducer mechanism positioned within the circular apertures of the grippers to receive the tubular material so that as the tubular material is advanced through said apertures it simultaneously circumferentially surrounds the introducer mechanism thereby placing the continuous capsule between said introducer mechanism and said grippers, means for moving the arches to open and close to thereby grip the tubular material and introducing mechanism, and means for programming the times of opening and closing of said grippers and the vertical movement of said second gripper to control the entraining and advancement of the continuous capsule on the neck of the bottle, and a cutting device mounted below the second gripper for cutting and forming the capsule before the capsule is placed on the neck of the bottle.

2. The bottle-sealing machine of claim 1 wherein said retention mechanisms include two pairs of rotatably mounted, star-shaped discs having a plurality of arms radiating therefrom which, arranged in correspondence with the body and the neck of the bottle, retain it in a delimited position facing said introducer mechanism and permit its advance by means of their rotation when the capsule has been placed in position, wherein the rotation of the discs, intermittent in correspondence with its number of arms, is effected out by means of ratchets installed on the lower ends of vertical shafts provided for each pair of discs below the platform of said bed frame, said two ratchets being operated by a common pneumatic or hydraulic cylinder and having the same number of teeth as said star-shaped discs have arms, the movement of said ratchets being synchronized with the rest of the mechanisms of the machine.

3. The bottle-sealing machine of claim 1 wherein said headpiece has two vertical and parallel spindles on which a vertical plate is assembled, said spindles being related with the hollow interior of said guides fastened to said bed frame, wherein said plate has two pairs of rings which clamp said guides with the possibility of sliding; one of said spindles having an operating handwheel on its upper end and a pinion which, by means of a suitable driving chain, is connected with a second pinion fixed to the upper end of the other spindle with which the perfect synchronization of the two spindles is achieved for displacement of the headpiece.

4. The bottle-sealing machine of claim 1 wherein each of said grippers includes a rectangular frame which, in the the first gripper, is fixed to said headpiece, while in the the second gripper, is made fast to a shoe that is displaceable on vertical guides operated by said connecting rod, a semicylindrical toothing being fastened in said frame, while the other is slideably assembled in opposition and fastened to the rod of a pneumatic or hydraulic cylinder duly secured to said frame.

5. The bottle-sealing machine of claim 1 wherein said introducer mechanism for the continuous capsule is constituted by a rod provided with a head of suitable shape to facilitate the introduction of the end of the coil into it and had a base that can come to a stop on a ring-shaped support installed coaxially above said first gripper and secured to its support; said rod being partially covered in its lower zone by a bushing which can displace downwards on it against the tension of a spring situated between them.

6. The bottle-sealing machine of claim 5 wherein when said second gripper is closed, in its extreme superior position, said first gripper is open, said second gripper displacing downwards together with said bushing and the continuous capsule to an extreme superior position, while said rod keeps its original position because it comes to a stop on the bottle mouth; said first gripper closing at this moment in order for said second gripper to then open and permit the ascent of said bushing through the effect of said spring with the continuous capsule being in a position of rest.

7. The bottle-sealing machine of claim 1 or 5 wherein between said two grippers a photoelectric cell is situated which governs an electrovalve which governs said second gripper in relation to the height established for the capsule and in relation to corresponding frames existing on the continuous capsule, so that the closing of this gripper simultaneously with the opening of the other, at a determined point of the ascending run of the gripper, determines the magnitude of the real entrainment in the following descending half-cycle in accordance with the dimensions established for the capsule.

8. The bottle-sealing machine of claim 1 wherein said cutting device is situated below said second gripper and said cutting device includes a body which displaces with the gripper itself and in which blades which swivel due to the action of a rocker are assembled in such a way that said body adopts an annular configuration, encircling said introducer device and, by means of bearings, supports a blade-carrier crown which receives a movement of continuous or intermittent rotation from a pneumatic motor connected by a belt, each rocker having a guide in opposition to the blade, and a conical face of a cam acting on all the guides so that when said cam is retracted, said blades cut the capsule; withdrawal of said cam being synchronized with the rest of the mechanisms of the machine.

9. The bottle-sealing machine of claim 1 or 8 wherein in the shaft of the motor which causes the alternative continuous movement of said second gripper, there is a pinion which, by means of a suitable chain, transmits movement to another pinion secured to a camshaft in such a way that the different cams on the camshaft govern, with suitable synchronism, the electrovalves corresponding to the different cylinders of the machine and to the pneumatic motor of the cutting device, when the movement of the latter is intermittent, with the exception of the cylinder which corresponds to the opening and closing of said grippers governed by said photoelectric cell.

10. The bottle-sealing machine of claim 1 wherein on said transporter belt and at the output of said retention mechanisms which retain the bottles for the encapsuling process, another pair of star-shaped discs are provided which act as a retention stop for the bottle in the step following positioning of the capsule and which keep it in position facing an elastic rammer which displaces together with said second gripper and which determines the definitive positioning of the capsule at a constant height, the movement of said other star-shaped discs being synchronized with the retention discs by means of a chain geared to pinions secured to the shaft of one of the latter and its own shaft.

11. The bottle-sealing machine of claim 1 wherein in the zone where the bottles are to be sealed, a detection element is provided which, in the absence of a bottle at the beginning of any of the cycles of the machine, puts the mechanisms which entrain the continuous capsule out of operation in order to avoid useless consumption of the material.

12. The bottle-sealing machine of claim 11 wherein said detection element is a microswitch.

13. The bottle-sealing machine of claim 11 wherein said detection element is a photoelectric cell.

* * * * *